428-408 SR
3/10/81 XR 4,255,483

United States Patent [19]
Byrd et al.
[11] 4,255,483
[45] Mar. 10, 1981

[54] FIRE BARRIER COMPOSITIONS AND COMPOSITES

[75] Inventors: Norman R. Byrd, Villa Park; John K. Donahoe, Long Beach, both of Calif.

[73] Assignee: McDonnell Douglas Corporation, Long Beach, Calif.

[21] Appl. No.: 806,540

[22] Filed: Jun. 14, 1977

[51] Int. Cl.[3] ..... B32B 7/00

[52] U.S. Cl. ..... 428/245; 260/45.85 R; 260/45.85 V; 428/251; 428/256; 428/260; 428/266; 428/268; 428/273; 428/408; 428/417; 428/418; 428/435; 428/920; 428/921; 528/353

[58] Field of Search ..... 106/15 FP; 260/37, 37 SB, 260/37 EP, 37 N, 38, 45.7 R, 45.8 ST, 45.85 R, 45.85 V; 428/245, 251, 256, 260, 266, 268, 273, 331, 391, 395, 408, 417, 418, 435, 920, 921; 528/353

[56] References Cited

U.S. PATENT DOCUMENTS

| | | | |
|---|---|---|---|
| 3,457,214 | 7/1969 | Modie | 260/37 SB |
| 3,488,319 | 1/1970 | Miller | 260/37 SB |
| 3,523,056 | 8/1970 | Horning | 428/229 |
| 3,565,851 | 2/1971 | Neuroth | 260/37 SB |
| 3,582,458 | 6/1971 | Haller | 428/251 |
| 3,604,257 | 9/1971 | Serlin | 428/251 |
| 3,642,681 | 2/1972 | Hermes | 427/372.2 |
| 3,644,135 | 2/1972 | Speyer | 427/337 |
| 3,649,588 | 3/1972 | Skipton | 260/37 SB |
| 3,700,538 | 10/1972 | Kennedy | 428/251 |

OTHER PUBLICATIONS

Condensed Chemical Dictionary, 8th Edition, Gessner G. Hawley.

*Primary Examiner*—James J. Bell
*Attorney, Agent, or Firm*—Max Geldin

[57] ABSTRACT

Fire barrier composition particularly applicable as an acoustic panel-fire wall structure in aircraft, capable of withstanding a 2,000° F. flame temperature, comprising incorporating a silica-containing material such as silicic acid or the reaction product of silicic acid and maleic anhydride, into a resin, particularly a polyimide resin. The resulting silica-containing resin, e.g. silicic acid-filled polyimide, is then applied to a substrate such as graphite fiber or glass cloth, to form a composite structure, which is then cured. The resulting cured composite when subjected to high temperature, e.g. a 2,000° F. flame temperature, forms silicon carbide and/or silicon nitride, in situ, which stabilizes any char that forms.

17 Claims, 2 Drawing Figures

FIRE BARRIER COMPOSITIONS AND COMPOSITES

BACKGROUND OF THE INVENTION

This invention relates to thermal insulation materials having high fire resistance and low thermal conductivity, and is particularly concerned with resin compositions and composites, particularly polyimide resins and composites formed therewith, incorporating substances in the resin to substantially increase fire resistance, and which are particularly applicable as an acoustic panel-fire wall structure in aircraft.

In order to reduce aircraft weight, thereby saving fuel, it is desirable to use graphite-resin composites in as many areas as possible. One location for use of such composites is the engine nacelle; and one application in that area is the acoustic panel. However, this area is also in the hot zone. Thus, in addition to serving as an acoustic panel, it must also serve as a fire barrier between the hot zone of the engine and the outer region, which contains fuel lines, hydraulic lines, electrical components, etc. Furthermore, there is an FAA requirement that any fire barrier used in the engine nacelle must be capable of withstanding a 2,000° F. flame for 15 minutes.

Thus, using graphite-polyimide as the composite, a structural component is available that has good strength, is light weight and has some fire resistance, in that the polyimide will not burn at low flame temperatures. However, at 2,000° F. flame conditions, the polyimide will burn and decompose to form a relatively stable char. This char, however, will allow heat to pass through to the backside and decompose the resin. This, in turn, creates a hazard due to the possibility of the decomposition products igniting, thereby starting a fire, even though the parent polymer (polyimide) will not readily burn. Therefore, a need exists for a non-burning resin that has good stability and low thermal conductivity.

Various ways have been suggested to effect protection of the acoustic panel-fire wall structure. One approach is to use a titanium face shield over the panel, thereby preventing a fire from getting through. Another approach is to use a high silica glass fabric face shield, or a silicone rubber impregnated high silica glass fabric. In the first instance, use of titanium does not help in weight reduction over use of graphite-polyimide composite. In the second approach, the high silica glass fabric or silicone-rubber impregnated high silica glass fabric also offers some protection, but it again necessitates the use of an extra barrier over the acoustical panel.

It is therefore necessary that some substance be incorporated into the polyimide that will give direct protection to the polyimide by being non-burning, have a low thermal conductivity, and be a char stabilizer. As mentioned above, there may be employed either a face shield of titanium, glass fabric or silicone-rubber impregnated glass fabric. Another alternative is to incorporate hydrated aluminum oxide directly into the polyimide for fire protection. Each of these methods is satisfactory, but suffers from limitations, such as increase in weight, e.g. in the case of titanium, removal of the water of hydration from the hydrated aluminum oxide, i.e., the water is known to come off at around 350° F., which is the cure temperature of the polyimide, and the like.

Examples of the prior art relating to the present invention are set forth below.

U.S. Pat. Nos. 3,356,525 and 3,644,135 are directed to coating or impregnating carbon fibers or cloth with various metal carbides obtained by reacting carbon-containing materials or polymers with various metals.

U.S. Pat. Nos. 3,523,056 and 3,604,257 are directed to the production of glass cloth impregnated with a polyimide resin.

U.S. Pat. No. 3,642,681 discloses a coating composition containing a polysilicic acid component.

A number of patents including, for example U.S. Pat. No. 3,079,273, disclose formation of various silicon carbide articles.

Accordingly, one object of the invention is to provide resin compositions and composites having high fire resistance and low thermal conductivity. Another object is the provision of compositions and composites of the above type having utility as a fire barrier, and particularly applicable as an acoustic panel-fire wall structure in aircraft, capable of withstanding high temperature, e.g. a 2,000° F. flame temperature. A still further object is the provision of resin compositions, particularly polyimide compositions and composites, such as polyimide-glass fabric composites or laminates, having incorporated therein a substance which substantially increases the fire resistance of the resin and reduces its thermal conductivity, and functions to stabilize the resin or resin char, at high temperatures, e.g. a 2,000° F. flame temperature.

SUMMARY OF THE INVENTION

The basic concept, according to the invention, is to introduce a substance that can be chemically incorporated into a resin such as polyimide, and which, upon being subjected to the 2,000° F. flame condition, can form silicon carbide and/or silicon nitride, in situ. Since these latter compounds are thermally stable to temperatures considerably higher than 2,000° F., and since they are relatively low thermal conductivity ceramic-type substances, their presence substantially stabilizes any char that may form.

One substance that can be used for this purpose is silicic acid, a commercially available form being meta silicic acid, $H_2SiO_3$. However, silicic acid is an insoluble substance and in preferred practice is solubilized by first dissolving maleic anhydride in a solvent such as N-methyl-pyrrolidone, and then adding the silicic acid in molar equivalence, forming the reaction product

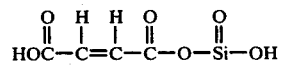

which is a clear gel, in the N-methyl-pyrrolidone. Subsequently, polyimide or polyimide precursor, e.g. polyamic acid, is added to form an homogeneous solution. This is then applied to glass cloth to form a prepreg and the polyimide is cured to obtain a silicic acid-incorporated polyimide.

Thus, according to a preferred embodiment of the invention, it has been found that by reacting silicic acid with maleic anhydride in N-methyl-pyrrolidone solution, a product is formed that when incorporated into a polyimide resin, applied to a substrate such as glass cloth, and cured, offers considerable protection against burning. In addition, a stable char is formed that demonstrates lower thermal conductivity than the untreated polyimide. Thus, upon being subjected to a 2,000° F. flame condition, the subject material can form silicon carbide and/or silicon nitride in situ, which are thermally stable at temperatures considerably higher than 2,000° F., and stabilizing any char that may form.

The silica containing material incorporated into the resin, particularly polyimide resin, can be silicic acid, including metasilicic acid, which is commercially available, and orthosilicic acid, silica, including colloidal silica and amorphous silica, silica gel, and silicates, such as ethyl silicate, and mixtures of these materials. All of these materials are termed herein "silica containing material." The preferred such material is silicic acid. These silica containing materials can be incorporated directly into the resin, e.g. polyimide resin.

However, in the case of silicic acid, as previously noted, it is preferred to first react the silicic acid with an anhydride, particularly maleic anhydride, to form a gel, which can more readily be incorporated into the resin, particularly the polyimide. For this purpose, other anhydrides, such as pyromellitic dianhydride or 3,3',4,4'-benzophenone tetracarboxylic acid dianhydride can be employed.

The silica containing material, e.g. silicic acid, preferably is incorporated into a polyimide resin according to the invention. Such polyimide can be either a condensation type polyimide or an addition type polyimide. However, the silica containing material can also be incorporated into other resins, e.g. epoxy, polybenzimidazoles, polyquinoxylines, phenolics and silicones, in order to enhance their fire resistance. Examples of such resins include the epoxy resin produced by condensation of bisphenol A and epichlorohydrin; the polybenzimidazole which is the reaction product of 2,2'-diamino benzidine with the phenyl ester of p,p'-diphenyl ether benzoic acid; the polyquinoxyline which is the reaction product of 2,2'-diamino benzidine with a bis benzene glyoxal; phenol-formaldehyde resins; dimethyl polysiloxanes and methyl phenyl polysiloxanes.

The silica containing material, such as silicic acid, silica gel or colloidal silica, can be added to the resin, e.g. polyimide, in varying proportions, e.g. ranging from about 10 to about 80 parts, per 100 parts of resin, e.g. polyimide, by weight.

Substrates to which the silica containing resin, e.g. silica filled polyimide, can be applied, include graphite fibers or fabric, glass fabric, particularly high silica glass fabric such as the material marketed as "Refrasil," low melting point metals such as aluminum, and the like. The composite of silica containing resin, e.g. silicic acid filled polyimide, and substrate, can be formed into several plies to produce a laminate, e.g. a silicic acid filled polyimide-glass fabric laminate, and cured.

In addition to use in aircraft engines, the silica containing, e.g. silicic acid, treated composites can also be used as fire walls in homes, autos, between the passenger compartment and either the engine or the gas tank, in trains, etc.

DESCRIPTION OF PREFERRED EMBODIMENTS

As previously noted, the silica containing material can be employed in an amount ranging from about 10 to about 80 parts per 100 parts of resin solids, by weight. In the case of the employment of silicic acid or silica gel, alone, that is in the absence of maleic anhydride, about 26 to about 40 parts of silicic acid or silica gel, based on 100 parts of the resin solids is employed, an optimum amount being about 40 parts of such silica containing material to 100 parts of resin solids, by weight.

Where silicic acid and maleic anhydride are incorporated into the resin, e.g. polyimide, the silicic acid is preferably employed in a proportion of about 16 to about 50 parts, and the maleic anhydride in an amount of about 10 to about 60 parts, per 100 parts of resin solids, the preferred range being from about 26 parts silicic acid and 32 parts maleic anhydride, up to about 47 parts of silicic acid and about 59 parts of maleic anhydride, per 100 parts of resin solids, by weight.

Where silica, e.g. colloidal or amorphous silica, alone is employed for incorporation into the resin, e.g. polyimide, preferably about 20 to about 60 parts, and particularly about 40 parts, of such silica is incorporated per 100 parts of resin solids, by weight.

The silica containing material such as silicic acid, silica gel, colloidal silica or ethyl silicate, or mixtures thereof, can be added to the resin, e.g. polyimide, in the required amount, and the resulting mixture applied to the substrate such as graphite fabric or glass fabric to form a composite or a laminate utilizing a plurality of fiberglass or graphite cloth plies. The composite is then cured at elevated temperatures ranging from about 200° to about 350° F. for curing, usually although not necessarily, followed by a post curing operation at higher temperatures ranging from about 400° to about 600° F.

In preferred practice employing silicic acid together with maleic anhydride, the silicic acid powder preferably is added to a solution of maleic anhydride in a solvent such as N-methyl pyrrolidone, forming a gel, and to such gel is added the resin, e.g. polyimide. Such solution is then employed to impregnate the substrate such as graphite fabric or glass cloth to form the composite or laminate, which is then cured as noted above.

The cured composites or laminates are subjected to flame tests employing a burner flame at a temperature of 2,000° F. In these tests the sample composite is mounted vertically, and the flame is impinged on the front face of the composite or laminate, and the temperature of the front face at 2,000° F. is monitored by a thermocouple. Under such conditions samples with substantially reduced burn-off areas on the back face of the composite or laminate after exposure to the 2,000° F. flame for 15 minutes, show stabilization and thermal stability of the resin char and reduced thermal conductivity of the char, due to the presence of the silica containing material.

The following are examples of practice of the invention, taken in connection with the accompanying drawings wherein:

A BRIEF DESCRIPTION OF THE DRAWINGS

EXAMPLE 1

Figure 1:
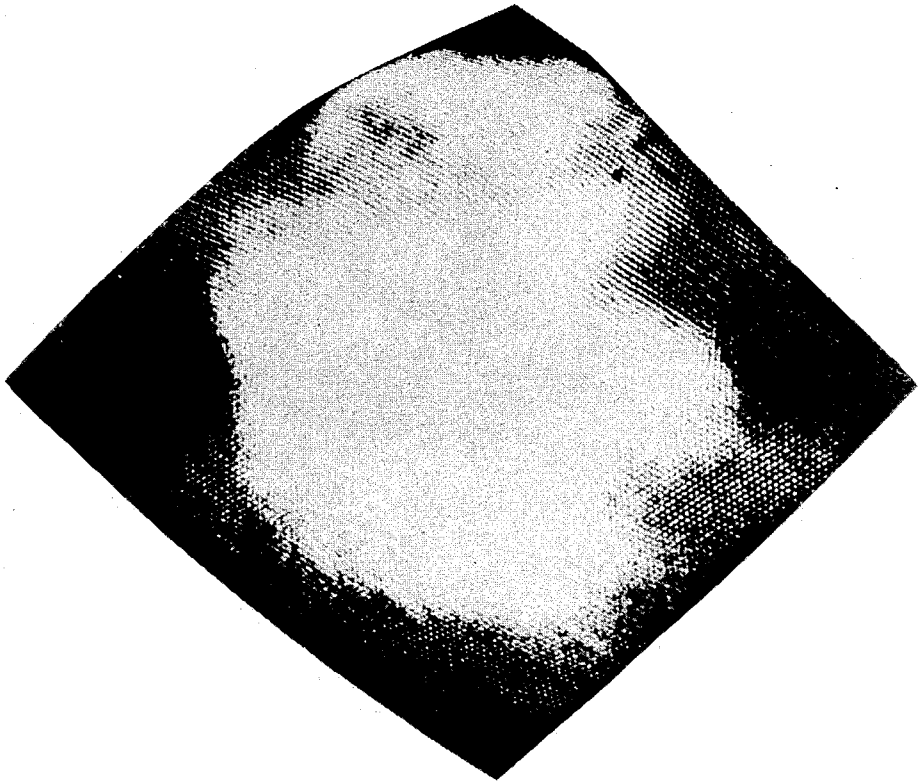
FIG. 1 is a photograph of a polyimide impregnated glass fabric laminate control, showing the burn-off area on the back face thereof, after being subjected to a burner flame at 2,000° F.

The following materials were employed in the preparation of a silicic acid-filled polyimide laminate:

76.6 grams N-methyl pyrrolidone
48.2 grams Maleic anhydride
38.3 grams Silicic acid ($H_2SiO_3$)

230 grams Skybond 703 polyimide varnish (a condensation type polyimide marketed by Monsanto)
8 plies of style 181 Fiberglass cloth (marketed by Owens Corning)

In a one liter beaker, 76.6 g N-methyl pyrrolidone and 48.2 g maleic anhydride were mixed until dissolved. 38.3 g silicic acid was added and the mixture stirred thoroughly at high speed for one hour. The resultant gel was permitted to stand overnight. 230 g Skybond 703 was added with thorough mixing for 30 minutes. This mixture was used to impregnate 181 glass cloth which was laid up isotropically over an Armalon (fluorocarbon release fabric marketed by Du Pont) surface, that is on a lay-up plate. After one hour exposure to the air, the lay-up was vacuum bagged in the normal manner, using one ply of Armalon on 4 plies of style 1534 glass bleeder (commercial glass fiber cloth), and placed in an oven using full vacuum and cured as follows:

One hour at 175° F., then work out gas bubbles. Increase temperature to 225° F. for 30 minutes, then increase temperature to 275° F. and hold for 20 minutes. Cool and de-bag. Re-bag using new Armalon over the laminate plus one ply of Mochburg bleeder fabric and a minimum amount of 1534 glass cloth bleeder. Use full vacuum and cure one hour at 175° F., one hour at 275° F. and a minimum of 2½ at 350° F. Cool, de-bag and subject to post cure. This is accomplished by placing sample in cold oven, bringing the temperature up to 550° F. and holding for 4½ hours.

Skybond 703 is usually sold as a polyamic acid varnish which is converted to a polyimide during heating and curing. However, Skybond 703 is usually referred to as the "polyimide varnish," even though it requires curing to convert it to the polyimide.

Illustrated below is the reaction between the maleic anhydride/silicic acid product and the 703 polyamic acid varnish to form the siliconated polyimide.

Samples of the cured siliconated polyimide glass fabric laminate and samples of a polyimide-impregnated glass laminate control employing the same amount of polyimide and using 8 plies of style 181 fiberglass cloth, as for producing the siliconated polyimide glass fabric laminate above, and cured by the procedure described above, were subjected to a Meeker burner flame maintained at 2,000° F. by means of a thermocouple, for a period of 15 minutes.

Figure 2:
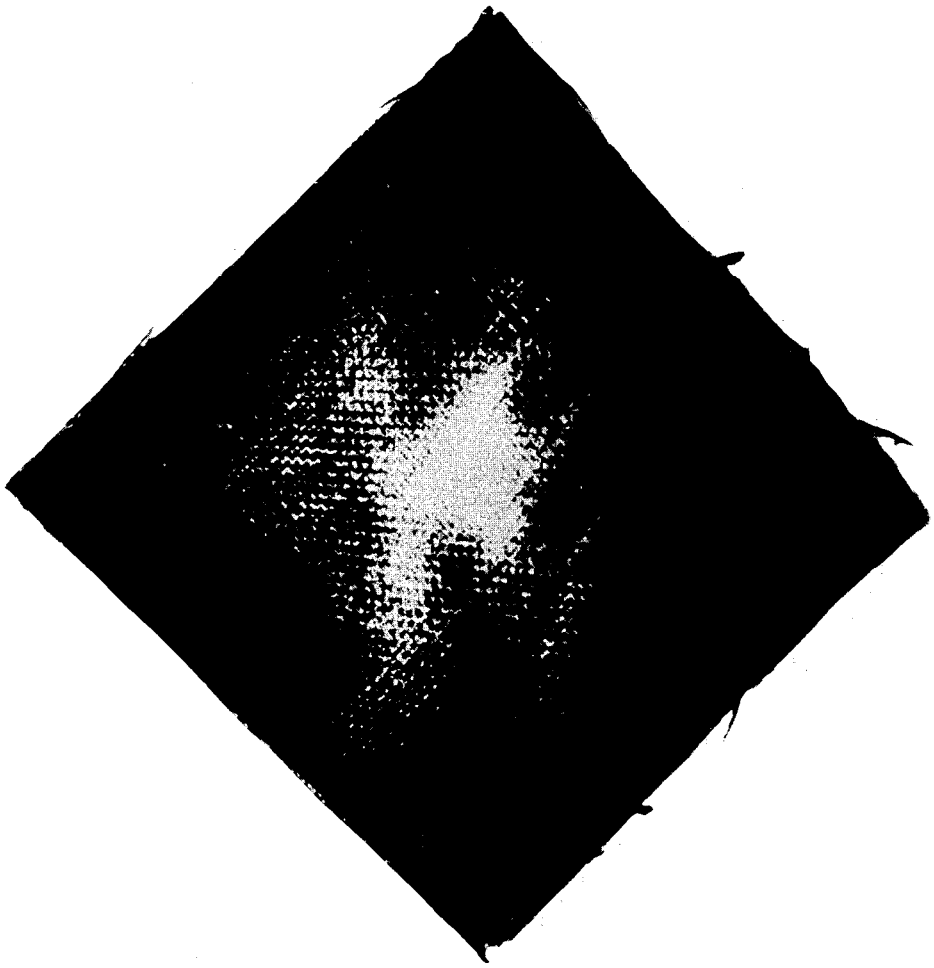
FIG. 2 is a photograph of a silicic acid-treated polyimide impregnated glass fabric laminate according to the invention showing the burn-off area on the back face thereof.

FIG. 1 of the drawing shows the large burn-off area on the back or rear face of the polyimide-impregnated glass laminate control and FIG. 2 shows the considerably reduced burn-off area on the back face of the silicic acid filled polyimide glass laminate prepared according to this example.

This example and FIGS. 1 and 2 of the drawing show that the resin char formed at the 2,000° F. flame temperature with the silicic acid filled polyimide glass laminate of the invention, can be stabilized, and the siliconated char has reduced thermal conductivity, apparently due to the formation of silicon carbide and/or silicon nitride, in the siliconated char. Thus, it can be seen that the presence of the silicic acid in the resin not only stabilizes the char formed, but reduces the resin burn-off on the back face of the laminate due to reduced thermal conductivity of the char.

Similar results can be obtained employing silicic acid alone, in the absence of the maleic anhydride, as shown below, but the presence of the latter aids to incorporate the silica containing material or filler more uniformly throughout the polyimide resin.

EXAMPLE 2

The following materials were employed:
76 grams N-methyl pyrrolidone
60 grams $H_2SiO_3$

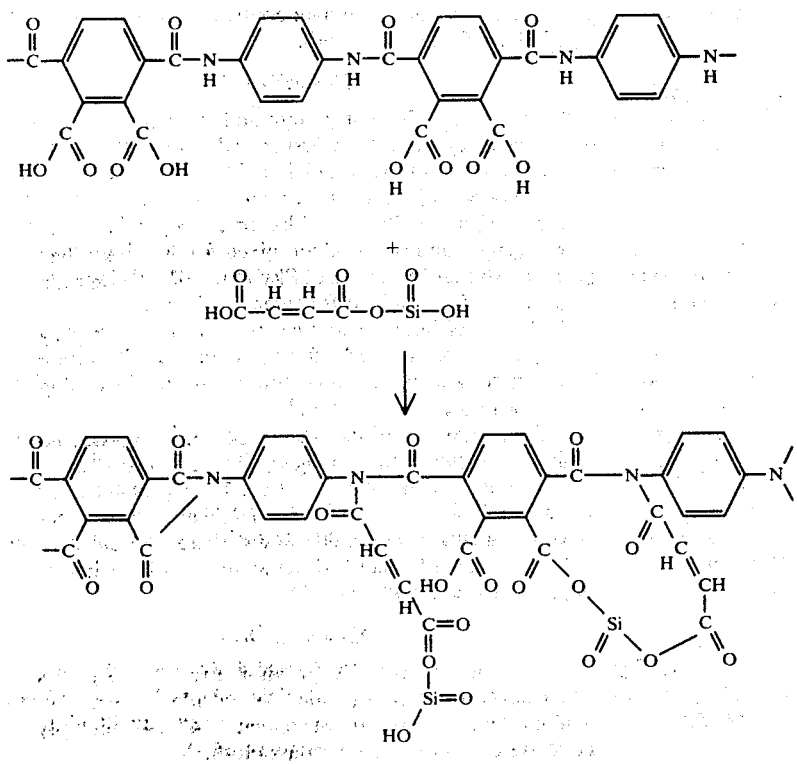

230 grams Skybond 703
8 ply style 181 glass cloth

The N-methyl pyrrolidone and the silicic acid were mixed for one hour and allowed to set, the silicic acid settling to the bottom of the container.

The Skybond 703 (polyimide resin) was added and mixed therein for twenty minutes. The resulting thin mixture was applied to the glass cloth until it was well saturated and the laminate was allowed to set for one hour at room temperature.

The lay-up was then vacuum bagged and placed in an oven maintained for one hour at 175° F. The temperature was increased to 225° F. for 30 minutes and then increased to 275° F. and held for about 20 minutes and then cooled and de-bagged.

The laminate was re-bagged using new Armalon and cured under full vacuum, as follows: 1 hour at 175° F., 1 hour at 275° F., and a minimum of 2½ hours at 350° F. Cool and de-bag.

The laminate was then subjected to post curing in an oven at 550° F. for 4½ hours.

Samples of the cured siliconated polyimide glass fabric laminate and samples of a polyimide-impregnated glass laminate control employing the same amount of polyimide and the same number of plies of style 181 fiberglass cloth, as for producing the siliconated polyimide glass fabric laminate above, were subjected to a 2,000° F. flame for a period of 15 minutes.

After about 15 seconds a glow was observed on the front face of the silicic acid filled polyimide-glass laminate and a glow appeared on the back face thereof in about 50 seconds. It was observed that there was some smoking after about 25 seconds but no flaming. After 15 minutes, the amount of burn-off area on the rear face of the silicic acid treated samples was much smaller than the amount of burn-off area on the rear face of the polyimide-impregnated glass laminate control. It was noted that the control burned on the back face thereof whereas the silicic acid filled samples did not.

EXAMPLE 3

A mixture of 30 grams of Skybond 703 polyimide resin and 4.9 grams silica gel was used to impregnate nine 4"×4" plies of fiberglass cloth to form a laminate.

The laminate was maintained for one hour at room temperature under vacuum, followed by one hour and fifteen minutes at 175° F., at which point air and excess resin were squeezed out. The temperature was increased to 265° F., and held at this temperature for one hour, and then increased up to 350° F. for one hour, and cooled under vacuum.

The cured laminate was then subjected to a fifteen minute flame temperature test at 2,000° F. It was noted that flaming occurred after twelve seconds and flame-out after 48 seconds. After fifteen minutes it was noted that about one half of the resin had burned out on the rear face. This was a greater amount of burn-out than when employing silicic acid, but less than was observed for samples of a polyimide-impregnated glass laminate control employing the same amount of polyimide and the same number of plies of fiberglass cloth.

EXAMPLE 4

A mixture of 30 grams of Skybond 703 polyimide resin, 6.3 grams silicic acid and 4.9 grams silica gel was used to impregnate nine plies of 4"×4" style 1581 fiberglass cloth.

The laminate was cured in accordance with the procedure of example 3 above.

In a flame test at 2,000° F. it was found that the resulting laminate did not give as good results as in the case of the use of silicic acid and maleic anhydride as in example 1, but the results were superior to a control of polyimide impregnated fiberglass cloth laminate of the same number of plies of fiberglass cloth.

EXAMPLE 5

A mixture of 60 grams ethyl silicate and 300 grams Skybond 703 resin was prepared and permitted to stand for 24 hours.

The above mixture was used to impregnate an 8 ply 181 fiberglass cloth (14"×14") isotropic laminate using the same curing and post curing procedure as in example 1 above.

In a flame test at 2,000° F. for fifteen minutes, it was observed that no flaming occurred and resin burn-off on the rear face of the laminate samples was satisfactory, although not as good as with silicic acid, or silicic acid and maleic anhydride.

EXAMPLE 6

34.8 grams maleic acid, 62.4 grams ethyl silicate and 75 ml. N-methyl pyrrolidone were mixed, and the mixture heated to reflux for two hours.

The resulting reaction mixture was mixed with 300 grams polyimide resin and this mixture was used to impregnate fiberglass cloth to form a laminate of 8 plies.

The resulting laminate was cured and post cured substantially according to the procedure of example 1 above.

The cured laminate was subjected to a 2,000° F. flame test for fifteen minutes. No flaming was observed and satisfactory burn-off of resin was observed on the rear face of the laminate, substantially less burn-off taking place than in the case of a control of a polyimide-impregnated glass laminate control of the same number of plies of fiberglass cloth.

EXAMPLE 7

76.6 grams N-methyl pyrrolidone and 48.3 grams maleic anhydride were first mixed, and to this mixture was added 38.3 grams silicic acid. To the resultant gel was added 100 grams of a mixture formed of 60 parts ethyl silicate to 300 parts Skybond 703 polyimide resin, by weight, and the product mixed for 30 minutes. Then an additional 150 grams of Skybond 703 polyimide resin was added and mixed for twenty minutes.

The resulting mixture was used to prepare a prepreg of 8 plies of style 181 fiberglass cloth. The resulting laminate was cured and postcured essentially according to the procedure of example 1.

In a 15 minute flame test at 2,000° F., there was no flaming observed and although burn-off of resin on the rear face of the laminate was somewhat greater than for use of silicic acid or silicic acid-maleic anhydride reaction product, and polyimide resin, there was substantially less burn-off than for a control of the polyimide-impregnated glass laminate.

EXAMPLE 8

270 grams Skybond 703 polyimide resin, 56.7 grams silicic acid and 36 grams maleic anhydride, were mixed. The mixture was used to impregnate a 4"×4", nine ply laminate of style 1581 fiberglass cloth.

The laminate was cured for one hour under vacuum, followed by one hour and fifteen minutes at 175° F. under vacuum. At this point air and excess resin were squeegeed out, and the temperature was increased to 265° F. and held for one hour under vacuum. Temperature was increased to 350° F. and held for one hour under vacuum.

The resulting cured laminate was then post cured for one hour at 350° F., four hours at 400° F., four hours at 500° F. and four hours at 600° F.

In a 2,000° F. flame test for 15 minutes, it was observed that a black char formed on the front face of the laminate, with no burning observed, and only a slight indication of burn-off on the rear face.

In the example below, an addition type polyimide was used to prepare a fiberglass laminate composite.

EXAMPLE 9

65 grams of 5230 addition type polyimide resin marketed by Narmco, were dissolved in 35 grams of N-methyl pyrrolidone to yield 100 grams of a 65% solids solution. This was used to impregnate a 6"×6" style 181 fiberglass cloth to make an 8 ply laminate. The laminate was cured in an autoclave at 100 psi and full vacuum. The temperature was raised at a rate of 4° to 6° F. per minute to 360° F. and the laminate was cured at this temperature for two hours.

The laminate was cooled and post cured for two hours at 400° F., two hours at 450° F. and six hours at 500° F. while being restrained between two caul plates and C-clamped to contact pressure to prevent warpage.

When subjected to a 2,000° F. flame, this control sample laminate burned immediately, and before 15 minutes were up, a hole had burned through the fiberglass cloth.

The test with the Narmco 5230 resin was repeated, but using the silicic acid/maleic anhydride additives, as described below, and the results noted below were obtained.

30 grams silicic acid were added to a 70 gram solution of N-methyl pyrrolidone that contained 40 grams maleic anhydride. These ingredients were thoroughly mixed in a one liter beaker, and allowed to sit overnight at room temperature. The next day, about ½ inch of gel had formed on the bottom of the beaker. The supernatant liquid (about 33 grams) was decanted off, and to the gel, which was first mixed for 10 minutes, was added 100 grams of a 65% solids solution of Narmco's 5230 addition type polyimide resin dissolved in N-methyl pyrrolidone. The solution was thoroughly mixed for another 10 minutes and used to make a 9"×9" 8 ply laminate with style 181 fiberglass cloth. The resultant laminate was autoclave cured and post cured, as described immediately above with respect to the control.

When subjected to a 2,000° F. flame, the sample burned for about 30 seconds, but did not burn off. It left a stable black char that withstood the full 2,000° F. flame for 15 minutes. This sample showed some evidence of delamination from the flame, but it did not burn a hole through the fiberglass as in the case of the control. This sample was thus better in its flame resistant properties than the non-silica treated control, but not as good as the laminate impregnated with Skybond 703 condensation type polyimide resin treated with silicic acid, as in Example 1 above.

From the foregoing, it is seen that the invention provides a fire barrier composition and composite of high fire resistance and low thermal conductivity, comprising a resin, particularly a polyimide, having incorporated therein a substance in the form of a silica containing material, particularly silicic acid, and more particularly a combination of silicic acid and maleic anhydride, and which functions to stabilize the char formed at high temperatures, e.g. at 2,000° F. flame temperature, due to the presence of silicon carbide and/or silicon nitride formed at such flame temperature, such compositions and composites being particularly valuable for use as a fire wall structure, and especially as an acoustic panel-fire wall structure in aircraft.

Since various modifications and changes in the invention will occur to those skilled in the art, within the spirit of the invention, the invention is not to be taken as limited except by the scope of the appended claims.

What is claimed is:

1. A fire resistant composition having low thermal conductivity, comprising a cured mixture of a resin selected from the group consisting of polyimide, epoxy, polybenzimidazole, polyquinoxyline, phenolic and silicone resins; and the reaction product of silicic acid and an anhydride, employing about 10 to about 80 parts of said reaction product per 100 parts of resin solids, by weight.

2. A fire resistant composition as defined in claim 1, said resin being a polyimide resin.

3. A fire resistant composition as defined in claim 1, said resin being a condensation type polyimide resin.

4. A fire resistant composition as defined in claim 1, said resin being an addition type polyimide resin.

5. A fire resistant composition as defined in claim 2, said reaction product being the reaction product of silicic acid and maleic anhydride.

6. A fire resistant composition as defined in claim 5, employing about 16 to about 50 parts silicic acid and about 10 to about 60 parts maleic anhydride, per 100 parts of resin solids, by weight.

7. A fire resistant composition as defined in claim 1, said composition when subjected to a flame temperature of 2,000° F. forming silicon carbide and/or silicon nitride in situ.

8. A fire resistant composition as defined in claim 2, said composition when subjected to a flame temperature of 2,000° F. forming silicon carbide and/or silicon nitride in situ.

9. A fire resistant composite having low thermal conductivity, comprising a substrate selected from the group consisting of graphite fabric and glass fabric, impregnated with a composition comprising a cured mixture of a resin selected from the group consisting of polyimide, epoxy, polybenzimidazole, polyquinoxyline, phenolic and silicone resins; and the reaction product of silicic acid and an anhydride, said reaction product being present in an amount ranging from about 10 to about 80 parts, per 100 parts of resins solids, by weight.

10. A fire resistant composite as defined in claim 9, said resin being a polyimide resin.

11. A fire resistant composite as defined in claim 10, said reaction product being the reaction product of silicic acid and maleic anhydride.

12. A fire resistant composite as defined in claim 11, said silicic acid being employed in amount ranging from about 16 to about 50 parts, and said maleic anhydride being employed in amount ranging from about 10 to about 60 parts, per 100 parts resin solids, by weight.

13. A fire resistant composite as defined in claim 10, said composite when subjected to flame temperature of 2,000° F. forming silicon carbide and/or silicon nitride in situ in said composition.

14. A fire resistant composition as defined in claim 5, employing about 26 to about 47 parts silicic acid and about 32 to about 59 parts maleic anhydride, per 100 parts of resin solids, by weight.

15. A fire resistant composite as defined in claim 11, said silicic acid being employed in an amount ranging from about 26 to about 47 parts, and said maleic anhydride being employed in an amount ranging from about 32 to about 59 parts, per 100 parts resin solids, by weight.

16. A fire resistant composition having low thermal conductivity, comprising a cured mixture of a resin selected from the group consisting of polyimide, epoxy, polybenzimidazole, polyquinoxyline, phenolic and silicone resins; and the reaction product of silicic acid and maleic anhydride, employing about 10 to about 80 parts of said reaction product per 100 parts of resin solids by weight.

17. A fire resistant composite having low thermal conductivity, comprising a substrate selected from the group consisting of graphite fabric, glass fabric and a low melting point metal, having applied thereto a composition comprising a cured mixture of a resin selected from the group consisting of polyimide, epoxy, polybenzimidazole, polyquinoxyline, phenolic and silicone resins; and the reaction product of silicic acid and an anhydride, said reaction product being present in an amount from about 10 to about 80 parts, per 100 parts of resin solids, by weight.

* * * * *